United States Patent [19]

Good et al.

[11] Patent Number: 4,701,139

[45] Date of Patent: Oct. 20, 1987

[54] SHIELDED CABLE ASSEMBLY

[75] Inventors: Robert S. Good, Etters; Michael J. Scully, Steelton; William E. Zelko, Dauphin, all of Pa.

[73] Assignee: AMP Incorporated, Harrisburg, Pa.

[21] Appl. No.: 856,610

[22] Filed: Apr. 25, 1986

[51] Int. Cl.[4] ..... H01R 9/07; H01R 13/658

[52] U.S. Cl. ..... 439/497; 29/857; 439/460; 439/607

[58] Field of Search ..... 339/106, 107, 143 R, 339/137, 89–98, 99, 176 MF, 17 F; 29/857

[56] References Cited

U.S. PATENT DOCUMENTS 3,876,276 4/1975 Ayer ..... 339/107

3,920,306 11/1975 Barnett et al. ..... 339/107 X 4,398,780 8/1983 Novotny et al. ..... 339/143 R X 4,460,230 7/1984 McKee et al. ..... 339/106

*Primary Examiner*—Eugene F. Desmond

*Attorney, Agent, or Firm*—Bruce J. Wolstoncroft; David L. Smith

[57] ABSTRACT

A cable assembly which couples multicontact connectors to multiple conductor cable. The multiple conductor cable having the conductors disposed in a planar array with the conductors being secured together at spaced locations. Electrical terminals of connectors are mass terminated to the conductors at the spaced locations. The connectors are arranged back-to-back and secured in a housing.

19 Claims, 12 Drawing Figures

SHIELDED CABLE ASSEMBLY

FIELD OF THE INVENTION

The invention relates to an electrical cable assembly for connecting multiple conductor cable to multicontact connectors, and more particularly to a shielded assembly with internal strain relief means for connecting shielded conductors to multicontact connectors.

BACKGROUND OF THE INVENTION

It is often desirable to connect a multiconductor cable to several communication devices or to other such cables. To this end a pair of multicontact connectors are often aligned back-to-back and connected electrically to each other and to the incoming multiconductor cable. This type of connector is well known in the industry as evidenced by U.S. Pat. No. 4,398,780. This patent discloses a shielded electrical connector for use with communication cable and the like, the cable having a metal sheath of foil or braided metal, to shield the conductors from electromagnetic interference. The conductors are exposed at the end of the cable for termination with the connector and consequently the housing of the connector will shield the exposed conductors in order for the connector to be effective. This is done by providing a metal shell as the housing, enclosing the connector and the conductor terminations. However, the invention discussed above, and the prior art in general, has a very time consuming and costly problem. For the above described invention to operate properly the individual conductors of the cable must be oriented to the proper terminal of the connector and terminated thereto. This process is very labor intensive. Accordingly, the present invention is directed to the achievement of a "piggyback" shielded cable assembly which has the added feature of being quickly and easily produced, eliminating much of the labor required to manufacture the assembly.

SUMMARY OF THE INVENTION

The invention is directed to an electrical cable assembly which includes a multiple conductor cable having the conductors disposed in a planar array with the conductors being secured together at spaced locations. Electrical terminals of electrical connectors are mass terminated to the respective conductors at the spaced locations. The connectors are arranged back-to-back and secured in position in a housing member.

The multiple conductor cable can be a round shielded cable and the housing member forms a shield for the connectors and is electrically connected to the housing member. In the alternative, the multiple conductor cable can be a shielded ribbon cable.

The housing member also includes strain relief structure for engagement with the cable and a cable receiving opening. The opening cooperates with the cable to form a seal to prevent dust and the like from entering the housing.

DETAILED DESCRIPTION OF THE INVENTION

Figure 1:
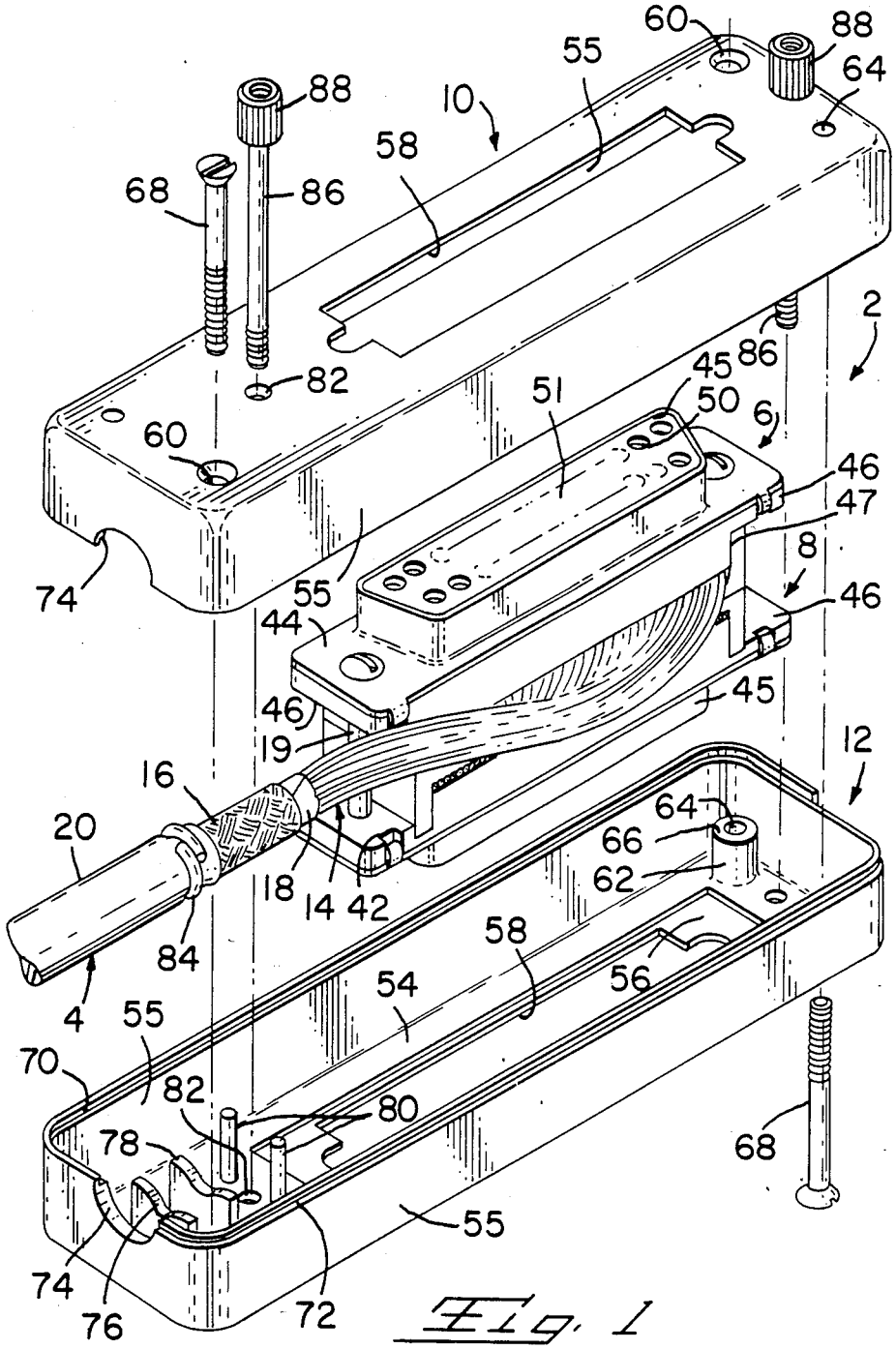
FIG. 1 is an exploded perspective view of a connector assembly according to the present invention.
Figure 2:
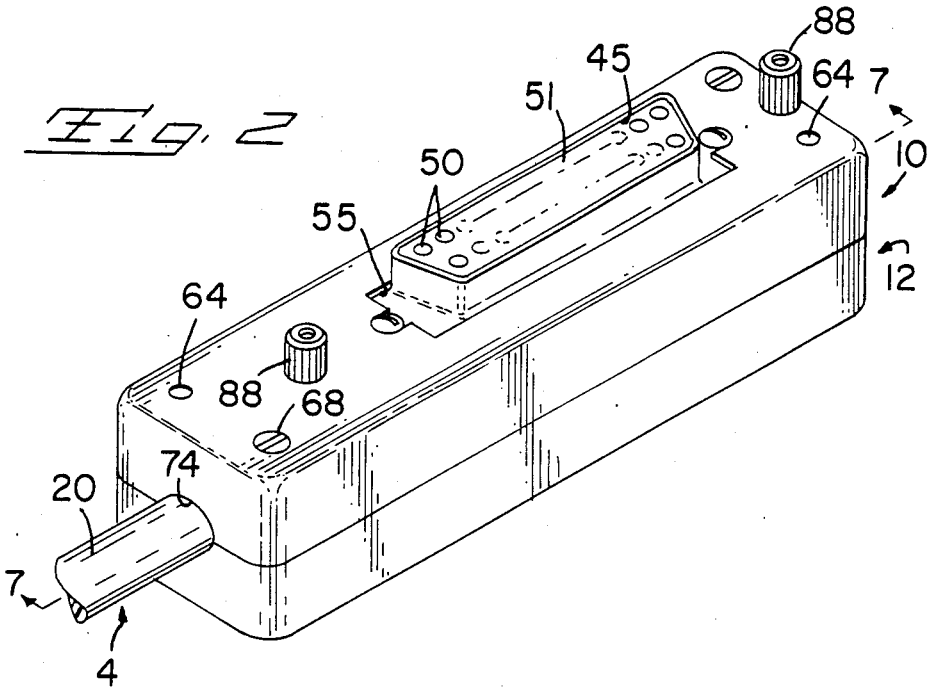
FIG. 2 is a perspective view of an assembled cable assembly.

Referring to FIG. 1, a shielded cable assembly 2, in accordance with the present invention, is designed to connect a shielded multiple conductor cable 4 to a male multicontact connector 8 and an female multicontact connector 6. The multicontact connectors 6, 8 are secured together in back-to-back condition and enclosed by hermaphroditic shells 10, 12.

Figures 4, 5:
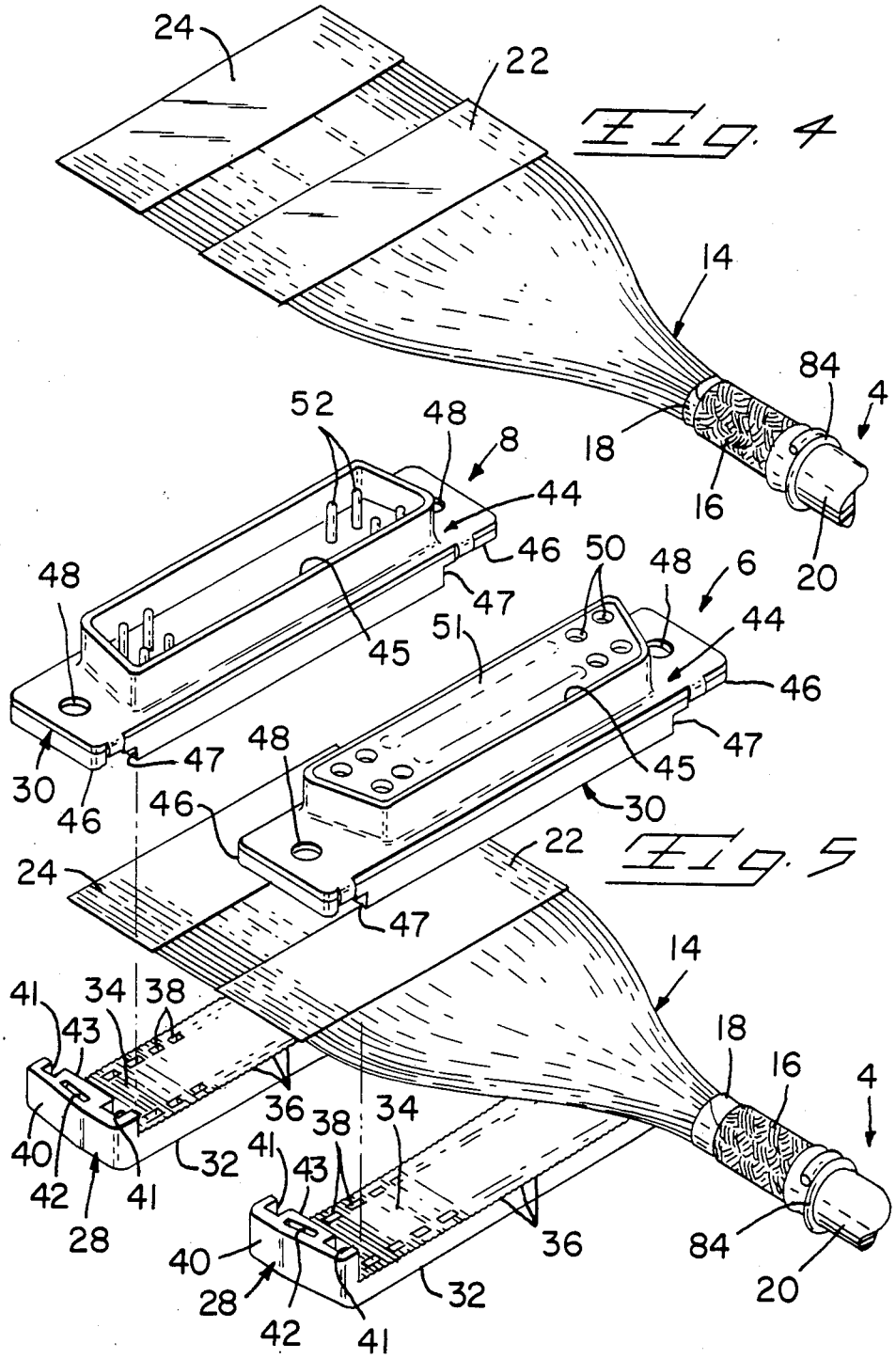
FIG. 4 is a perspective view of a stripped cable end showing individual conductors arranged in a planar configuration.
FIG. 5 is a perspective view showing connectors before termination to the conductors take place.
Figure 6:
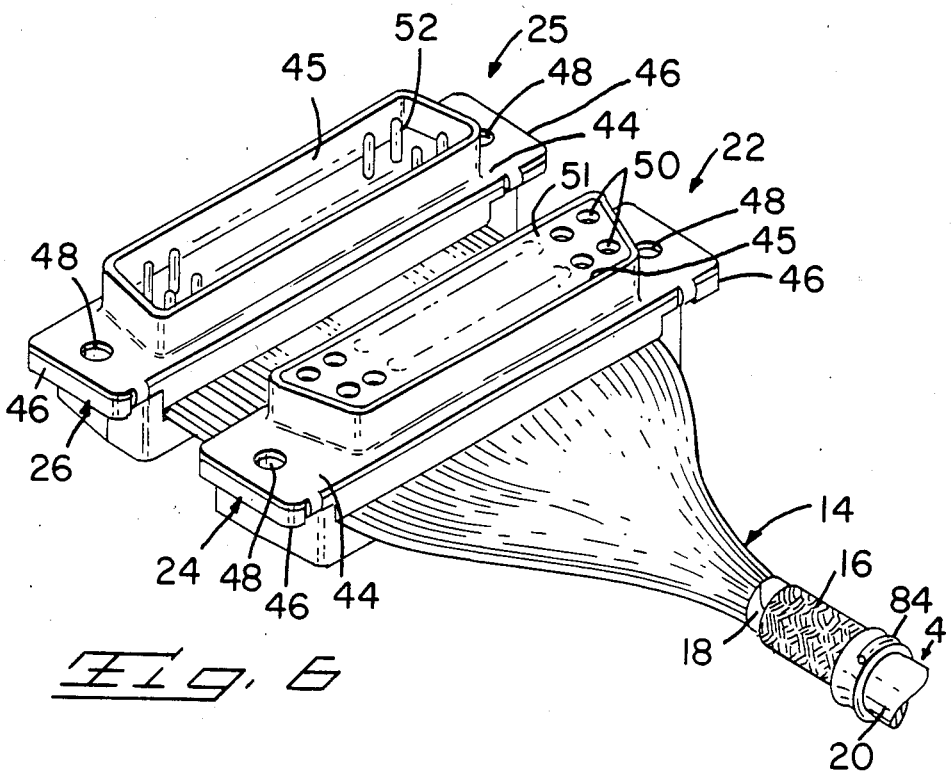
FIG. 6 is a perspective view similar to FIG. 4 showing the connectors after termination to the conductors.

The cable 4 is a commercially-available cable of the type having multiple insulated conductors 14 enclosed within a conductive sheath 16 of metal braid which surrounds a metal foil 18. The sheath 16 is contained within an outer jacket 20 of plastic material. An end of cable 4 is stripped such that individual conductors 14 are exposed. The exposed individual conductors 14 are enclosed by color-coded insulation and are fanned out into an organized planar configuration, as shown in FIG. 4. Conductors are maintained in this organized planar configuration by adhesive strips 22, 24. Alternatively, conductors 14 are maintained in position by heat bonding or chemically bonding the insulation together. The conductors are then connected to the multicontact connectors 6, 8 as discussed below. The multicontact connectors 6, 8 are of the type disclosed in U.S. Pat. No. 3,820,055, the disclosure of which is incorporated herein by reference.

Figure 9:
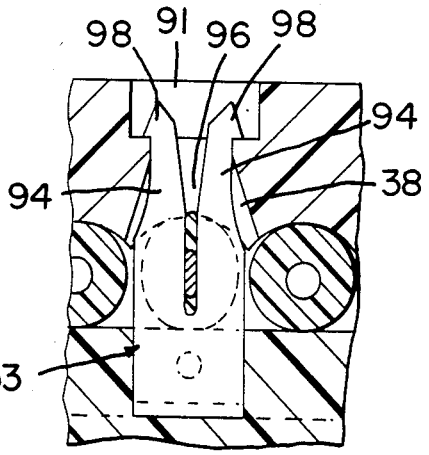
FIG. 9 is a part fragmentary view showing a terminating portion of a terminal of the connectors.

Each multicontact connector 6, 8 has a housing 25, 26 of rigid insulative material, each housing 25, 26 comprising a conductor positioning section 28 and a contact receiving section 30, as shown in FIG. 5. Each conductor positioning section 28 has a rear surface 32 and a top surface 34. Each top surface 34 has a plurality of conductor-receiving arcuate slots 36 for receiving individual conductors 14 of cable 4. The number of conductor-receiving slots 36 corresponds to the number of individual conductors 14 present in cable 4. A plurality of staggered slots 38 extend from rear surface 32 to top surface 34 in association with respective conductor-receiving slots 36. The number of terminal-receiving slots 38 corresponds to the number of individual conductors 14 of cable 4. Slots 38 will receive therein terminating portions of electrical terminals, as shown in FIG. 9. At each end of each conductor positioning section 28, a side wall 40 extends from top surface 34. Side walls 40 have a pair of channels 41 and a slot 42, slot 42 extending from rear surface 32 to upper surface 43 of side wall 40.

Contact receiving sections 30 of connector 6,8 have a metallic top plate 44 which has D-shaped projection 45. Top plate 44 is clamped onto flanges 46 which extend from side walls 47 of top portion 30. Holes in flanges 46 (not shown) are aligned with holes 48 of top plate 44 to allow insertion of screw 49 (FIG. 1).

Connectors 6, 8 differ with regard to the terminals present in housings 25, 26. Connector 6 has terminals with female-type contact portions disposed in openings 50 which are present in D-shaped section 51 located within projection 45, and connector 8 has terminals with male-type contact portions 52 disposed in D-shaped projection 45. However, each terminal has identical terminating portions 53 (FIG. 9). Terminating portions 53 have spaced arms 94 which define insulation displacing conductor-engaging slots 96. The entrance to slots 96 are tapered so as to define a guide for guiding conductors 14 to be terminated therein. Arms 94 have barbed ends 98 which cooperate with conductor positioning section 28 to secure sections 28, 30 together, as discussed below. Although this type of arrangement is shown, it should be noted that any combination of male and female connectors may be used.

Shells 10, 12 are identical to each other and are fabricated from die cast zinc and plated with nickel or copper to provide improved electrical conduction. As shown in FIG. 1, each shell 10, 12 includes a bottom wall 54, side walls 55 and end walls 57. An interior cavity 56 is provided on bottom wall 54. Interior cavity 56 has an opening 58 to allow D-shaped projections 45 of the appropriate connector 6, 8 to extend beyond shell 10, 12 such that projection 45 and the contact portions of the terminals can be engaged by the projection and contact portions of a matable connector.

Holes 60 are provided in bottom wall 54 in two diagonally opposed corners. Provided in the two remaining corners are projections 62 each having a threaded hole 64 extending from an inner end 66 of projection 62 to an outer surface of shells 10, 12. The holes 60, 64 cooperate with screws 68 to hold shells 10, 12 in place as discussed below. Outside ridges 70 and inside ridges 72 provided at the top of side walls 5 and end walls 57 also cooperate as the shells are brought together.

Shells 10, 12 define an eliptical cable-receiving opening 74. On bottom wall 54 proximate opening 74 is a projecting arcuate strain relief cradle 76, a side of which (not shown) is attached to projection 62. Another strain relief cradle 78 is provided inward of cradle 76. Conductor direction guides 80 are provided inward of cradle 78 on bottom wall 54 on either side of opening 82 to direct the conductors 14 to either side of opening 82. A cable retention ring 84 is clamped onto jacket 20 of cable 4. Ring 84 is positioned between opening 74 and first relief cradle 76 as shown in FIG. 7.

Figure 7:
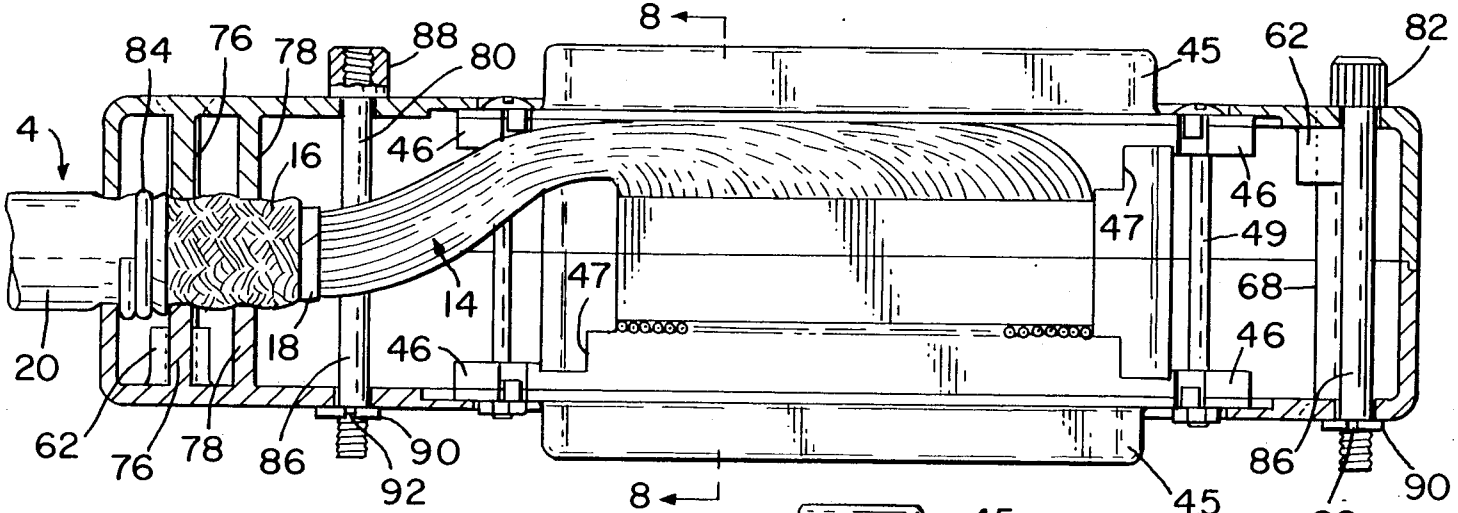
FIG. 7 is a cross-sectional view taken along line 7—7 of FIG. 2 showing the internal strain relief means provided on the shell.
Figure 8:
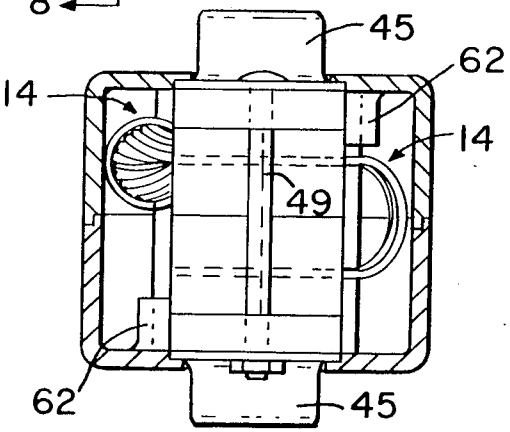
FIG. 8 is a cross-sectional view taken along line 8—8 of FIG. 7 showing the path of the conductors of the cable.

Jack screws 86 having enlarged threaded ends 88 are inserted into aligned holes 82 as shown in FIG. 7, and E-rings 90 are swapped into slots 92 of screws 86 to retain screws 86 in position. Jack screws 86 enable cable assemblies 2 to be stacked in a piggyback manner, as will be discussed later.

An important aspect of this invention is the assembly procedure. The jacket 20, sheath 16, and metal foil 18 are stripped from the end of cable 4. The individual color-coded conductors 14 are then arranged in an organized planar configuration, as shown in FIG. 4. The number of individual conductors 14 present in each cable 4 will range, in typical connectors, from nine to fifty. Organizing conductors 14 in this manner ensures that the appropriate individual conductors are properly connected to cable assembly 2 as well as other cable assemblies at the opposite end of cable 4. The spacing between conductors 14 will vary according to the type of connectors 6, 8 to which the conductors 14 are to be connected, so that the spacing of conductors 14 conforms to the spacing of the terminals in connectors 6, 8. After conductors 14 have been organized and spaced, the adhesive strips 22, 24 are applied to the conductors 14 to maintain the organized planar configuration of the conductors. The adhesive strips 22, 24 are placed on conductors 14 in spaced-apart orientation.

Conductors 14 are then terminated with connectors 6, 8. Connectors 6, 8 are attached to conductors 14 at the spaced-apart locations which correspond to the adhesive strips 22, 24. This ensures that conductors 14 are properly spaced as discussed above. Connectors 6, 8 can be terminated on conductors 14 simultaneously or individually according to the equipment available. Conductor positioning sections 28 of connectors 6, 8 are brought into engagement with conductors 14. Conductor-receiving slots 36 of housings 28 contact conductors 14 and guide them therein. With one conductor in each slot, the contact receiving section 30 of connectors 6, 8 are forced into engagement with conductors 14 and conductor positioning section 28. Housings 28, 30 are latchably connected as the terminating portions of the terminals effect electrical contact with conductors 14 as disclosed in U.S. Pat. No. 3,820,055. Briefly, as the contact receiving section 30 is moved downward, the upper ends of arms 94 of each terminating portion 53 pierce the insulation of conductor 14. As downward movement proceeds, conductors 14 are forced into the inner ends of slots 96 until they are located in the portions of the narrow slots causing arms 94 to electrically contact conductors 14. Outside edges of arms 94 engage terminal receiving slots 38, forcing arms 94 inward thereby ensuring positive electrical contact. Barbed ends 98 contact bottom surfaces of recesses 91 which are in communication with slot 38, as shown in FIG. 9, securing sections 28, 30 together.

The connectors 6, 8 are then brought into a back-to-back position and secured in this position by screws 49 mounted through holes 48 as shown in FIGS. 1 and 7. Conductors 14 of cable 4 and connectors 6, 8 are then enclosed by shells 10, 12. As the shells 10, 12 are engaged, cable 4 rests on the arcuate strain relief cradles 76, 78 and opening 74, as shown in FIG. 7. Ring 84 must be positioned between opening 74 and cradle 76. With the shells now in the closed position, screws 68 are inserted into holes 60 and threadably engage threaded holes 64 of projections 62 thereby securing shells 10, 12 together.

In this secured position, cradles 76, 78 and opening 74 form a passageway which is narrower than cable 4; therefore cable 4 is compressed by cradles 76, 78 and opening 74 preventing movement of cable 4, as shown in FIG. 7. This compression causes cable 4 to form a seal with opening 74, preventing dust and the like from entering cable assembly 2. To further ensure that cable 4 does not axially move, ring 84 is positioned such that ring 84 will engage end wall 57 or cradle 76 as the cable is pulled or pushed, thereby limiting movement of the cable in either direction.

In this secured position, metal plates 44 of connectors 6, 8 make electrical contact with shells 10, 12 while cradles 76 of shells 10, 12 make contact with conductive sheath 16 of cable 4. Thus, shells 10, 12 and metal plates 44 are commoned electrically to the cable sheath to assure unbroken continuous shielding.

Jack screws 86 are provided so that the cable assemblies may be stacked in "piggyback" style as described in U.S. Pat. No. 4,398,780. Briefly, elongated jack screws 86 pass through openings 82 in shells 10, 12. Threaded end 88 of each screw 86 is threadably advanced into corresponding threaded ends of another set of jack screws 86 which are assembled to the other cable assembly 2.

Figure 3:
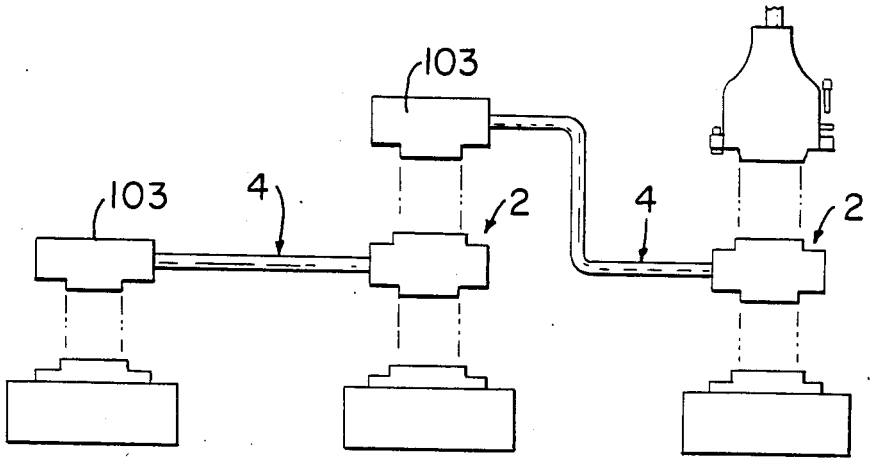
FIG. 3 is a schematic view showing how the connector assembly interacts with other devices.

Once assembled, cable assembly 2 is used in combination with other cable assemblies. As shown in FIG. 3, cable 4 is attached to cable assembly 2 at one end and attached to a right angle cable assembly 103, discussed below, at the other end. This arrangement allows a master electronic device to be connected to a plurality of slave electronic devices while still permitting individual slave devices to operate independently from each other. As an example, slave 95 may be disconnected from cable assembly 2 with no effect on master 97 or slave 99. This type of system allows individual slave devices to be repaired, etc., without impacting the master device or any other slave devices present in the system.

Figure 10:
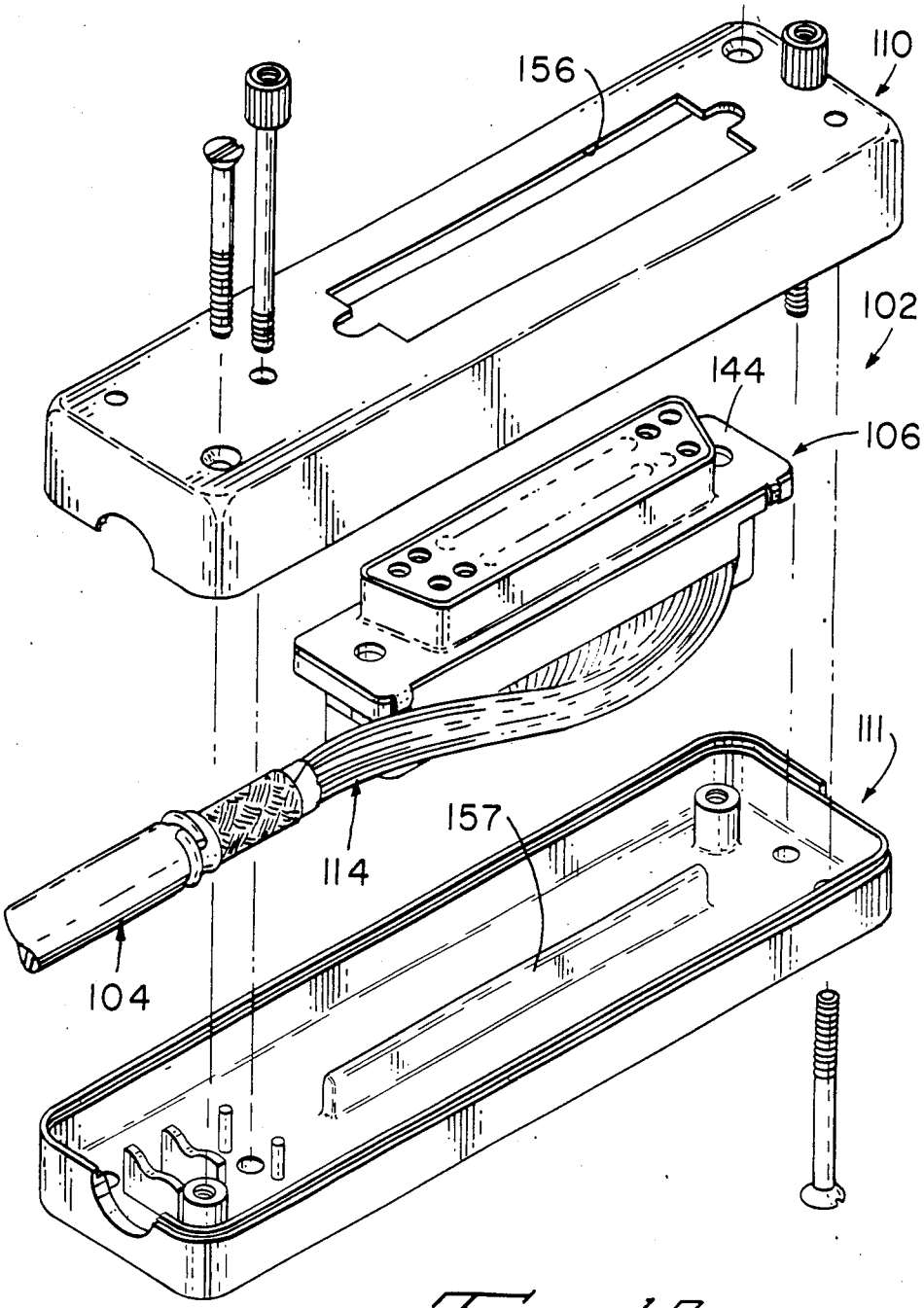
FIG. 10 is an exploded perspective view of an alternative embodiment of the invention.

As mentioned, right angle cable assembly 103 is connected to cable 4 at the opposite end of cable assembly 2. As shown in FIG. 10, right angle cable assembly 103 is similar to cable assembly 2 except that only one connector 106 is terminated to the individual wires 14 of cable 4. Therefore, only one shell 110 is required to have an opening 156. Shell 110 is identical to shells 10, 12 described above. The other shell 111 has a ridge 157 in place of opening 156. Ridge 157 engages conductor positioning section 128 when right angle assembly 103 is assembled, ensuring that connector 106 is positioned such that metallic top plate 144 makes electrical contact with shell 110, allowing continuous shielding to occur. Jack screws 286 allow the assembly 103 to be piggybacked, as described above, to other assemblies 2, 103.

Figure 11:
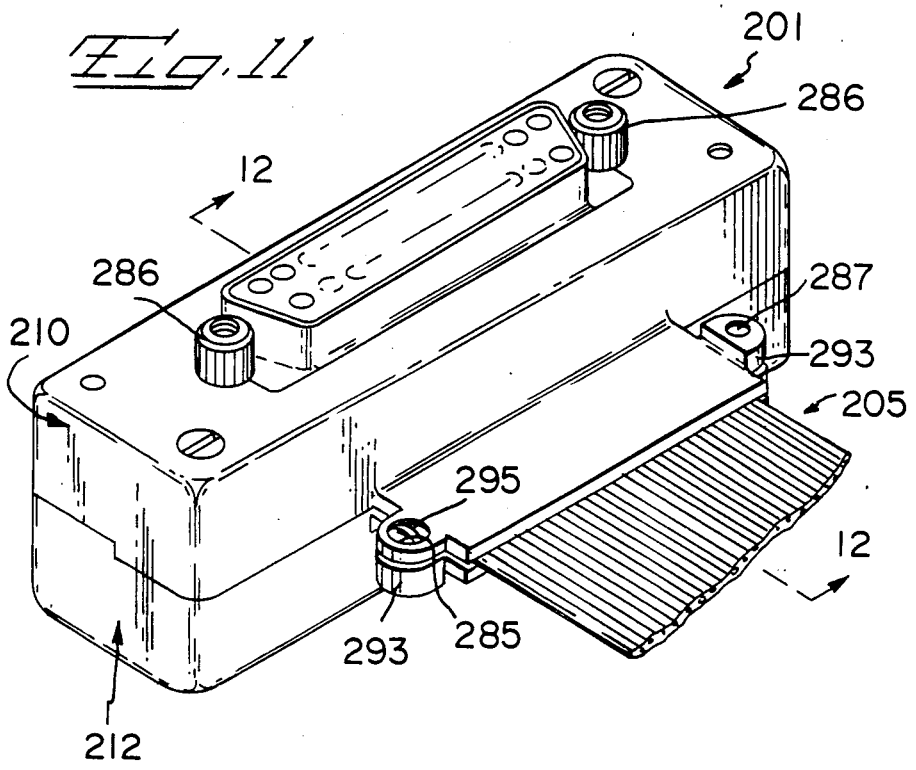
FIG. 11 is a perspective view of an assembled cable assembly according to a second alternative embodiment.
Figure 12:
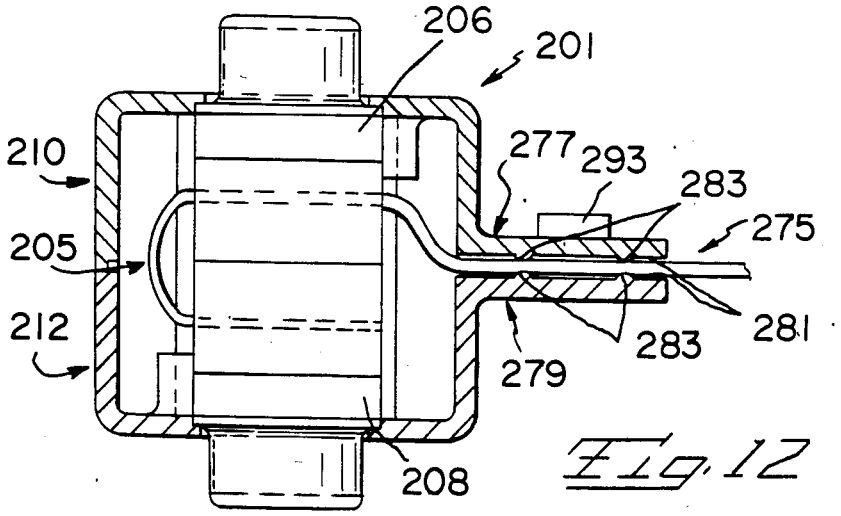
FIG. 12 is a cross-sectional view taken along line 12—12 of FIG. 11 showing the path of the ribbon cable.

A second alternative embodiment, cable assembly 201, is shown in FIGS. 11 and 12. In this embodiment, a ribbon cable 205 replaces round cable 4 and enters from the side of shells 210, 212 as shown in FIG. 11. Strain relief 275 differs from the strain relief configuration previously disclosed. Strain relief 275 extends outwardly from shells 210, 212 as shown in FIG. 11. Consequently shells 210, 212 are hermaphroditic.

Strain relief 275 comprises a top plate 277 and a bottom plate 279, which are integral with shells 210, 212 respectively, each having interior surfaces 281. Opposing embossments 283 are provided on interior surfaces 281 of plates 277, 279 for engagement with cable 205, as shown in FIG. 12. Embossments 283 grip cable 205 providing strain relief and preventing movement thereof. Holes 285 are provided on top plate 277 and bottom plate 279. Projections 293 extend outwardly from an end of plates 277, 279. Restricted diameter holes 287 are provided on projections 293. Holes 285, 287 are positioned such that hole 285 of one plate is aligned with hole 287 of the other plate. Screws 295 are threadably inserted through holes 285, 287 securing strain relief 275 to cable 205. Alternatively, holes 287 have restricted diameters which cooperate with self-tapping screws such that, as the screws are inserted, the threads of the screws engage holes 287 causing a threading action to occur, thereby securing strain relief 275 to cable 205.

Alternatively, ribbon cable 20 is a shielded cable. Embossments 283 of strain relief 275 of housings 210, 212 make contact with the shielded cable causing strain relief 275 and shells 210, 212 to be commoned electrically to the cable assuring unbroken continuous shielding.

Jack screws 286 are used to piggyback the assemblies 201 in the manner previously disclosed as well as to secure connectors 206, 208 in a back-to-back orientation. Consequently, since the strain relief configuration of the embodiment of FIGS. 1–9 is not necessary and jack screws 286 have been moved inward, assembly 201 occupies less space than assembly 2.

As disclosed, the invention relates to an electrical cable assembly which permits individual conductors of a multiple conductor cable to be mass terminated to electrical terminals of electrical connectors. The connectors are then positioned and secured in a back-to-back configuration. A housing encloses the connectors and provides strain relief for the cable.

We claim:

1. An electrical cable assembly comprising:

a multiple conductor cable having individual insulated conductors disposed in a planar array, said conductors uniformly spaced with respect to each other in said array;

means for securing the planar array of individual conductors at axially spaced locations;

electrical terminals of electrical connectors terminated to the respective conductors at the spaced locations; and means for securing the electrical connectors in back-to-back orientation.

2. An electrical cable assembly as recited in claim 1, wherein the means for securing the individual conductors is an adhesive applied to the conductors.

3. An electrical cable assembly as recited in claim 1, wherein the individual conductors are arranged in an organized manner that corresponds to the arrangement of conductors at the opposite end of the cable.

4. An electrical cable assembly as recited in claim 1 wherein the means for securing the individual conductors comprises heat bonding of insulatin of the conductors.

5. An electrical cable assembly as recited in claim 1 wherein the means for securing the individual conductors comprises chemical bonding of insulation of the conductors.

6. An electrical cable assembly as recited in claim 1, wherein the multiple conductor cable is a round shielded cable.

7. An electrical cable assembly as recited in claim 6, wherein a metal housing is provided to cover the connectors, the housing being commoned electrically to the shielded cable to assure unbroken continuous shielding.

8. An electrical cable assembly as recited in claim 7, wherein strain relief means are provided to grip the cable providing strain relief, the strain relief means having a cable retention ring secured to an outer jacket of the cable, the cable retention ring cooperating with the housing to limit axial movement of the cable.

9. An electrical cable asembly as recited in claim 7, wherein the housing comprises first and second mated shells.

10. An electrical cable asembly as recited in claim 7, wherein jack screws extend through the housing to provide a means to connect together complementary electrical connectors in a piggyback arrangement.

11. An electrical cable assembly comprising:

an electrical cable having parallel electrical conductors disposed in an insulating jacket insulated from one another defining a ribbon cable;

electrical connector means having electrical terminals means therein, the electrical terminals of the electrical connector means terminated to respective electrical conductors of the cable at an end of the cable and at a location spaced inwardly from the end of the cable;

means for securing the electrical connector means terminated to the cable in back-to-back arrangement;

housing means in which the back-to-back connectors are disposed;

means for securing the housing means and the connectors together; and strain relief means provided by the housing means along which the cable extends and which the cable engages, whereby strain relief is provided to the cable.

12. An electrical cable assembly as recited in claim 11, wherein the means for securing the electrical connectors in back-to-back arrangement is a jack screw which also extends through the housing means to provide a means to connect together complementary electrical connectors in a piggyback arrangement.

13. An electrical cable assembly as recited in claim 11, wherein the strain relief means comprises a metal top plate and a metal bottom plate, the top and bottom plates having opposed embossments which engage the cable when the strain relief means is secured to the cable.

14. An electrical cable assembly as recited in claim 13 wherein the ribbon cable is shielded.

15. An electrical cable assembly as recited in claim 14, wherein the housing means is metal and is commoned electrically to the shielded cable through the strain relief means assuring continuous shielding.

16. A method for making an electrical cable assembly comprising the steps of:

stripping an end of a multiple conductor cable exposing individual insulated conductors;

positioning the individual conductors in a planar array, said conductors uniformly spaced with respect to each other in said array;

securing the individual conductors in a planar array at axially spaced locations;

mass terminating electrical terminals of electrical connectors onto respective condcutors of the cable at the spaced locations;

arranging the electrical connectors in a back-to-back orientation; and securing the electrical connectors in the back-to-back orientation.

17. A method according to claim 16, wherein positioning the individual conductors in a planar array further comprises the step of arranging the conductors in an organized manner to correspond to the arrangement of conductors at the opposite end of the cable.

18. A method according to claim 16 further comprising the step of securing a metal housing over the electrical connectors such that a continuous shield is formed between the housing and a shielded cable.

19. An electrical cable assembly comprising conductors of a multiple conductor cable, connectors having a plurality of terminals, the connectors secured in back-to-back orientation, the back-to-back connectors secured in a housing, jack screws provided in the housing to allow the housing to be secured to a complementary electrical connector, the cable assembly being characterized in that:

the individual conductors of the multiple conductor cable are disposed in a planar array, said conductors uniformly spaced with respect to each other in said array, and means for securing the individual conductors at axially spaced locations, whereby the plurality of terminals of the connectors are mass terminated to respective conductors of the cable at the axially spaced locations.

* * * * *